US005568666A

United States Patent [19]

Seibert

[11] Patent Number: 5,568,666

[45] Date of Patent: Oct. 29, 1996

[54] GAMING TABLE CLOTH

[76] Inventor: Gilbert E. Seibert, 771 Main St., Ashley, Ill. 62808

[21] Appl. No.: 462,808

[22] Filed: Jun. 5, 1995

[51] Int. Cl.[6] ..... D06B 1/10

[52] U.S. Cl. ..... 8/149.1; 8/158

[58] Field of Search ..... 8/149.1, 151, 158, 8/932, 149; 68/200

[56] References Cited

U.S. PATENT DOCUMENTS

| | | | |
|---|---|---|---|
| 3,129,442 | 4/1964 | Leckie | 8/149.1 |
| 4,116,626 | 9/1978 | Varner | 8/149 |
| 4,165,547 | 8/1979 | Parlin et al. | 8/149.1 X |
| 4,771,497 | 9/1988 | Fleissner | 8/149.1 X |
| 4,828,567 | 5/1989 | Robbins | 8/149 |
| 4,903,363 | 2/1990 | Robbins | 8/149 |

*Primary Examiner*—Philip R. Coe
*Attorney, Agent, or Firm*—Janal M. Kalis

[57] ABSTRACT

The present invention relates to a method for making a cloth for gaming and pool tables. The method includes providing a fibrous synthetic material having a top fibrous surface and a bottom screen surface. A mixture of dye and gel is prepared. The mixture of dye and gel is applied to the fibrous synthetic material in a manner effective to dye the top surface while leaving the bottom surface free of dye. The dyed cloth is cured with wet steam at about 211° to 235° F.

6 Claims, No Drawings

GAMING TABLE CLOTH

BACKGROUND OF THE INVENTION

The present invention relates to a method for coloring a synthetic textile for gaming tables and pool tables and gaming and pool tables with the colored cloth.

Gaming tables, such as are used in gambling casinos, and pool tables must meet certain requirements that are unique to the gaming and pool industry, respectively. One requirement concerns the formation and generation of lint. Another requirement concerns friction properties as the properties relate to pool balls.

Conventional gaming tables and pool tables include wooden legs and a wood or metal frame. The tables are typically overlaid with a material of wool felt. Wool felt has free fiber ends that impart desirable friction and texture properties to the cloth.

It is important that the cloth on the gaming table not generate lint and slough the lint fibers into the environment. The lint fibers can damage electronic equipment, typically in the vicinity of the gaming tables, such as electronic poker games, bingo games, and electronic slot machines.

One other problem associated with gaming tables covered with textile materials such as wool felt relates to use of the table. Gaming tables for use in casinos are frequented by hundreds of people each week. The material on the gambling tables absorbs human excretions such as sweat. Over time, the human excretions tend to degrade the material.

One additional problem associated with the textile material in a gaming table and a pool table is premature wear of the material. Depending upon the game, a constant friction caused by items such as cards or chips or pool balls being moved and manipulated on the table results in a premature wear of the wool felt.

The Robbins U.S. Pat. No. 4,828,567, issued May 9, 1989 describes an apparatus for setting dye in materials such as carpets and mats and so on. The device includes a confinement chamber that contains a swatch of the carpet. Steam is supplied to and released into the chamber from apertures in the chamber. The steam sets the dye in the carpet.

The Robbins patent, U.S. Pat. No. 4,903,363 issued Feb. 27, 1990, describes a multi-chambered confinement device. Each of the multi-chambers may receive a mat or carpet. Each chamber may also receive steam. A device steams multiple carpets and mats simultaneously.

SUMMARY OF THE INVENTION

The present invention includes a method for coloring a synthetic textile for use on gaming and pool tables. The method includes providing a fibrous synthetic textile having a denier within a range of about 70 to 100. The fibrous synthetic textile material has a top surface with fibrous free ends and a bottom patterned surface, substantially free of fibrous free ends. A mixture of dye and gel of desired dye strength and color is prepared by mixing the dye and gel. The mixture of dye and gel is then applied to the fibrous synthetic textile in a manner that is effective to dye the fibers of the top surface while leaving the pattern on the bottom surface substantially free of dye. Once dyed, the cloth fibers are cured with wet steam within a range of about 211° to 235° F.

DETAILED DESCRIPTION OF THE PREFERRED EMBODIMENTS

The process of the present invention treats a fibrous, synthetic textile for use on a pool table or gaming table in order to dye and retexturize the textile. The process includes selecting a porous, synthetic polymeric textile such as nylon, applying a dye in a gel carrier to the fibrous polymeric material with a roller at a pressure that is of a magnitude that prevents penetration of the dye through the material. Next, the dye treated fibrous textile is cured with steam within a range of about 211° to 235° F. The present invention also includes a dyed fibrous material for use on gaming tables and pool tables, having a brightness that is aesthetically pleasing under casino lights, and having a resistance to degradation when exposed to human excretion such as sweat, and having a resistance to frictional wear while being substantially free of lint forming tendencies.

It has surprisingly been found that with the process of the present invention, a synthetic nylon textile for use on gaming and pool tables may be treated having a desired color that includes one or more of colors red, green, black, white, yellow, burgundy, blue, combinations of these colors and patterns that are made with combinations of these colors. After the dyeing step, the textile includes a top dyed surface and a bottom surface substantially free of dye, opposing the dyed side.

The nylon textile also has desired frictional properties on each of the dyed surface and the reverse undyed surface, opposing the dyed surface. The reverse undyed surface has properties that permit low frictional movement to and across a plastic coated wire mesh attached to a frame used to position the material for curing.

Previous efforts at dyeing a fibrous textile such as nylon that is suitable for use on a gaming or pool table have yielded unsatisfactory results. The color in the material has been uneven because the dye has not penetrated interstices or pores in the synthetic fibers. This uneven distribution of dye has tended to produce a dyed fiber of an undesirable color tint.

Additionally, conventional dyeing methods have tended to cause dye to diffuse through the entire cloth material into the bottom surface during the dyeing step. This diffusion has been undesirable because the presence of the wet gel-dye on the bottom surface of the fibrous polymeric material has made the material very difficult to move at any process step following the dyeing step, such as the curing step.

In the present invention, an initial dye application step is manually performed with either a roller or a squeegee and a gel-dye mixture at a particular roller application force. The gel-dye mixture may be applied in conjunction with a selected silkscreen if a design is made on the textile surface. A water soluble gum is applied to the silkscreen and closes pores of the textile in a pattern of the desired design.

The roller application force is of a degree that prevents diffusion of the die through the cloth into the bottom surface while coloring all fibers on the top surface. The roller application is preferably against the fiber grain of the material. Once the gelled dye is applied with the roller or squeegee, the cloth can be transferred to a curing chamber for curing in steam at about 212° to 235 ° F.

The use of wet steam within a range of about 212° to 235° F. to cure the dyed porous synthetic fibers, such as nylon fiber, opens the pores of the fibers and permits a uniform distribution of the dye over the entire surface area of the porous polymeric fibrous material. The dye penetrates through the cloth during the curing step and dyes the bottom surface.

The fibrous, synthetic textile used in the process of the present invention is most preferably a nylon fiber having a denier of 70. It has also been found that nylon with a denier as high as 100 is acceptable but the color, when dyed, is not as bright as color of dyed nylon with the lower denier. It is believed that other synthetic textiles such as polyester are suitable for use in the present invention.

The material is most preferably woven with at least two threads and has a warped knit. In one preferred embodiment, a nylon textile is obtained from the Hardwood Mills of Lylsville, N.C. The nylon textile has a top surface with free fiber ends. The free fiber ends are oriented so that the top surface feels soft, smooth and "suede-like" when rubbed. The bottom surface of the nylon material is a smooth surface showing a knit pattern.

The nylon fibers have pores, thereby increasing the surface area that must be dyed. In one embodiment, the free nylon fibers on the top surface are knit fibers and are not twisted. The fibers are clipped to a "suede finish." The nylon fibers are warp knitted to form the nylon textile having the top surface and the bottom surface.

In one preferred embodiment, the synthetic nylon material is dyed by subjecting the material to dye application, curing of the dye into the synthetic fibers and dye setting. In one preferred embodiment, a roll of synthetic nylon cloth of about 120 yards of material is dyed. The roll is dyed in a manner that permits concurrent dye application to one section of the roll, curing of another section of the roll and dye setting of a third section of the roll. With this dyeing treatment, the roll of cloth is incrementally treated in all three dyeing steps prior to cutting. The concurrent treatment of the roll of cloth as described is more efficient in terms of time, dye ingredient usage and energy usage than conventional incremental dyeing methods.

During dye treatment, the nylon textile may be horizontally positioned and secured on a flat bed table that holds the nylon under tension. In One preferred embodiment, the textile is positioned and fastened horizontally on the flat bed table.

A gelled dye mixture is prepared. The mixture includes an acid based dye. The acid based dye is a conventional dye. One preferable acid based dye is manufactured by the Rit Company of Indianapolis, Ind. The Rit dye powder is mixed with boiling water and acid in a conventional manner and is then added to the gel. In one embodiment, the gel component, or substrate, of the mixture is a gum based gel manufactured by Rohn-Poulanc as Progesile No. 7.

The quantity of dye added to the gel depends upon the intensity of color desired. The quantity of gel depends upon the viscosity of gel-dyed mixture desired. The viscosity of the gel-dye mixture depends upon the color of dye applied.

The gelled dye mixture is manually applied to the nylon top surface with the metal roller or a squeegee. The roller or squeegee is of a conventional manufacture. Multiple colors are applied at about the same time by any conventional silkscreen application known to those skilled in the art. The time of application is about 4 minutes.

The roller is manually moved over the fibrous surface. As discussed, with either the roller or the squeegee, the force at which the gelled-dye mixture is applied to the cloth is of a degree that dyes the surface of the nylon textile but the dye does not penetrate to the underlying bottom surface. It has been found that application of the gelled-dye to the surface of the nylon textile with the roller permits a uniform color distribution and a complete dyeing of the top surface nylon fibers without a premature diffusion of the dye to the bottom surface of the textile.

With the application step of the present invention, the dye will not diffuse to the reverse surface over time prior to curing. As a consequence, the textile can be readily moved once the dye is applied because there is no increase in friction between the bottom surface and an external surface because of the presence of the wet, sticky dye-gel mixture. This feature makes the dyeing of a roll of cloth easier to perform.

Once dye is applied to the textile, the colored textile is pulled into the curing chamber. Within the curing chamber is a plastic coated wire mesh frame. The frame is positioned so that the textile is horizontal with the dyed surface up. The curing chamber includes a waterproof enclosure that can be sealed and that can withstand pressurization. In one embodiment, the waterproof enclosure has a rectangular base of about the same dimensions as the wire mesh frame. Once the textile is positioned in the enclosure on the frame, the textile forms a partition in the enclosure. While one frame is described, it is contemplated that the enclosure may include two or more frames to cure two or more rolls of cloth.

The curing chamber also encloses 1 to 2 gas burners. The gas burners boil water in pans resting over the gas burners. The pans containing boiling water are positioned below the textile. The textile is exposed to the steam rising from the pan of boiling water for a period of time ranging from 3 to 7 minutes in order to cure the dyed cloth. Blue dye requires the shortest time for curing of about 3 minutes. Burgundy requires the longest time for curing of about 7 minutes.

When the curing chamber is not pressurized, the steam is at a temperature of about 211 to 212 degrees Fahrenheit. When pressurized, the steam temperature increases to as high as about 235 degrees Fahrenheit.

Once the cloth is cured, the dyed, cured cloth is removed from the enclosure. Once removed, the cloth is rinsed in cold water in a dye setting tank. Once rinsed, the cloth may be washed in a conventional washing machine and is then air dried.

By treating a single roll of nylon or other synthetic textile, the dyeing steps may be performed semicontinuously in the steps of pulling the first section of the roll onto the flat bed table for dye application to the first section; pulling the first section into the curing enclosure and curing the first section in the curing enclosure, and dyeing the second section on the flat bed table; pulling the first section to the dye setting tank and setting the dye, curing the second section in the curing enclosure, and dyeing the third section of synthetic textile. Once the section of textile has been rinsed in the dye setting tank, the section is cut away from the roll, sized and washed and dried. Equipment such as the flat bed table and frame in the curing chamber are sized to color a suitable area of the roll. While one line has been described, it is contemplated that one can perform the method of the present invention in two or more lines, operating concurrently.

It has surprisingly been found that the dyed nylon fabric provides an excellent textile for use in gaming tables. The fabric is more economical than the wool felt conventionally used. The nylon fabric does not generate lint, retains excellent color in terms of brightness and has a desirable sheen under casino lights.

Although the present invention has been described with reference to preferred embodiments, workers skilled in the art will recognize that changes may be made in form and detail without departing from the spirit and scope of the invention.

What is claimed is:

1. A method for treating a cloth for gaming and pool tables comprising:

providing a fibrous synthetic material having a denier within a range of about 70 to 100, the fibrous synthetic material having a top surface with free fiber ends and a bottom patterned surface;

preparing a mixture of dye and a gel to make a gelled dye;

applying the gelled dye to the fibrous synthetic material in a manner effective to dye the top surface while leaving the bottom surface free of dye; and curing the dye treated fibrous synthetic material with wet steam from boiling water at 212° to 235° F.

2. The method of claim 1 wherein the fibrous synthetic material is a nylon material.

3. The method of claim 1 wherein the gelled dye is applied with a roller by hand.

4. The method of claim 1 wherein the gelled dye is applied with a squeegee by hand.

5. A method for dyeing a roll of synthetic textile for use on a gaming or pool table, comprising:

applying dye to a first segment of textile having a top surface and a bottom surface that has been withdrawn from the roll in a manner effective to dye the top surface while leaving the bottom surface free of dye;

curing the first segment of textile with wet steam from boiling water at 212° to 235° F. and dyeing a second segment of textile that has been withdrawn from the roll;

setting dye in the first cured segment of textile, curing the second segment of textile, and applying dye to a third segment of textile that has been withdrawn from the roll; and separating the first set, cured dyed segment from the roll of the textile.

6. A product made by the method of claim 1.

* * * * *